US005963771A

United States Patent [19]

Chan et al.

[11] Patent Number: 5,963,771

[45] Date of Patent: Oct. 5, 1999

[54] METHOD FOR FABRICATING INTRICATE PARTS WITH GOOD SOFT MAGNETIC PROPERTIES

[76] Inventors: Tien-Yin Chan, 49 Chung-Hwa Rd., Hsin-Shin Tainan; Shun-Tian Lin, #43, Sec. 4, Kee-lung Rd., Tapiei, both of Taiwan

[21] Appl. No.: 08/939,621

[22] Filed: Sep. 29, 1997

[51] Int. Cl.[6] ..... B22F 3/10

[52] U.S. Cl. ..... 419/2; 419/35; 419/37; 419/38; 419/46; 419/54

[58] Field of Search ..... 419/35, 37, 38, 419/2, 46, 54

[56] References Cited

U.S. PATENT DOCUMENTS

| | | | |
|---|---|---|---|
| 5,147,601 | 9/1992 | Ohtsuka et al. | 419/25 |
| 5,256,326 | 10/1993 | Kawato et al. | 252/62.54 |
| 5,796,018 | 8/1998 | Moyer et al. | 75/230 |

*Primary Examiner*—Daniel J. Jenkins

*Attorney, Agent, or Firm*—Bacon & Thomas

[57] ABSTRACT

In the present invention, nickel and phosphorous are simultaneously plated onto the surface of iron powder, mixed iron and nickel powder, or iron-nickel pre-alloyed powder, to form iron-nickel-phosphorous ternary alloy powders with very uniform distribution of phosphorous, with concentrations ranging between 2.0 and 6.0 wt%. When mixed with an appropriate amount of organic binder, these powders may be used as raw materials for injection molding. Intricate parts thus formed can be sintered at relatively low temperatures to attain high sintered density, large grain size, and isotropic shrinkage. The sintered microstructure thus obtained is characterized by spheroidal grains embedded in continuous intergranular insulating phosphide phase. The magnetic properties of the resulting material are substantially improved as compared to those of powder processed products. By controlling the fractions of phosphorous and nickel in the final ternary alloy, products that are intended for use in alternating magnetic fields with different frequencies can be produced.

4 Claims, 2 Drawing Sheets

METHOD FOR FABRICATING INTRICATE PARTS WITH GOOD SOFT MAGNETIC PROPERTIES

BACKGROUND OF THE INVENTION

1. Field of the Invention

This invention relates to a method for manufacturing intricate parts possessing good soft magnetic properties, using iron-nickel-phosphorous ternary alloy powders prepared by simultaneous electroless-plating of nickel and phosphorous onto the surface of iron powder or iron and nickel powder mixtures. The concentration of phosphorous is close to or higher than its maximum solubility in the solid solution of iron and nickel. When mixed with an appropriate amount of organic binder, these powders can be formed into intricate parts by standard metal injection molding procedures, which comprise of blending, granulation, injection molding, debinding, and sintering processes. Low sintering temperatures afford parts with high sintered density, isotropic sintered shrinkage, and a composite structure characterized by large spheroidal grains of solid solution of iron, nickel, and phosphorous imbedded in insulating iron-nickel phosphide. The magnetic properties thus achieved are substantially improved with respect to the prior practices.

2. Description of the Prior Art

Powder metallurgy process is very suitable for economical mass production of intricate soft magnetic components. Different materials, such as Fe—P, Fe—Ni, and Fe—Si alloys, are being produced via this route. The drawbacks of this process are, however, relatively poor and erratic magnetic characteristics of the final product, due to the existence of a large amount of residual porosity. For example, sintering of the mixture of Fe and Ni powders is difficult since sintering temperatures higher than 1300° C., followed by post-sintering secondary repressing and thermal annealing, are required to enhance their magnetic performance.

An alternative approach to enhance material transfer is incorporating a metalloid element, such as phosphorous, to form a liquid phase during sintering. The Fe—P system has been promoted commercially in recent years as a new soft magnetic material, which is being claimed to be capable of replacing virtually all other high performance soft magnetic powder metallurgy materials. Nevertheless, phosphorous is generally added in the form of $Fe_3P$, causing microscopically non-uniform distribution of phosphorous element in the powder mixture. This results in existence of large pores and segregation of phosphorous subsequent to sintering. The optimum fraction of phosphorous is thus limited to 0.4 and 0.8 wt %, and, consequently, the effect of phosphorous on enhancement of sintered density is restricted. Increase in the phosphorous concentration can improve the uniformity of distribution of phosphorous in the powder mixture, but the major drawback of large sintered shrinkage rate, associated with high temperature sintering of Fe—P alloy system by press-and-sinter process, precludes this possibility. For example, Fe—0.8% P alloy is often used as an improved material beyond the popular Fe—0.45% P alloy, but it exhibits a greater sintered shrinkage and distortion in press-and-sinter practice. In such a case, a coining operation is often needed to control the dimensions of the part, and a subsequent low temperature thermal anneal is required to remove the surface deformation without altering the dimensional control, as the surface region is the only area that is magnetized and demagnetized in alternating magnetic fields.

As per a U.S. Pat. No. 5,505,760 issued in U.S. Patent Gazette dated Apr. 9, 1996, soft magnetic properties of powder processed iron based alloys are improved by using powders prepared by mixing SnP powder, or Sn and $Fe_3P$ powders, with iron powder. However, again due to the microscopically non-uniform distribution of the alloying elements, the concentration of tin should be maintained higher than 4.5 wt % to be effective in improving the sintered density and, consequently, soft magnetic properties.

Eddy current losses play a major role in core loss in applications involving alternating magnetic fields. The above mentioned material systems possess low magnitudes of electrical resistivity and are used primarily in applications involving very low frequencies, as eddy current losses account for a large energy loss. In practical terms, only the electrical resistivity and sample thickness can be modified to minimize the eddy current losses. Hence, the strategies that have been devised to overcome these energy losses include constructing laminated composites composed of magnetic foils separated by insulating polymer films, and forming magnetic powder—polymer composites. However, these approaches suffer from degradation of magnetic inductance arising from the polymeric materials. Additionally, for powder processed materials, the thickness is not a parameter that can be used as a variable to control the eddy current losses. Electrical resistivity is therefore the only control variable that can be used in powder metallurgy to control the eddy current losses.

In a recent work (U.S. patent pending) by Materials Innovation Inc. (West Lebanon, N.H.), an electro-deposition coating technology has been developed, wherein the coating layer on the iron powder surface imparts lubrication during pressing and forms a highly electrically resistive compound encompassing each iron grains, subsequent to a low temperature sinter. The eddy current loss in an alternating magnetic field with frequencies ranging from 20 to 500 Hz is thus dramatically reduced. However, an electro-deposition coating process possibly suffers non-uniformity of thickness of the coated materials among the particles, arising from the inhomogeneous density of electric current, and thus requires sophisticated equipment to assure consistent quality of products.

Ternary Iron-nickel-phosphorous alloy powders have also been prepared by electroless plating. However, the intention of such approach is to enhance the sintered strength by incorporation of phosphorous, while simultaneously avoiding intergranular precipitation of brittle phosphides. In addition, coated composite powder with high concentration of phosphorous is very difficult to press due to its inherent high hardness. Thus, the phosphorous concentration in these ternary alloy powders is usually conservatively low (<0.5 wt %).

Based on the above discussion, it is the objective of the present invention to provide a process wherein mass production of Fe—Ni—P ternary alloy powders can be tailored without the use of costly equipment, and intricate soft magnetic components with excellent magnetic properties, especially high saturation magnetization as well as high electrical resistivity, in an alternating magnetic field can be economically mass-produced.

SUMMARY OF THE INVENTION

It is the objective of the present invention to provide a method for manufacturing soft magnetic components with excellent magnetic properties in alternating magnetic field.

To achieve the above mentioned objective, coated ternary iron-nickel-phosphorous composite powders are produced by simultaneous electroless-plating of nickel and phosphorous onto the surface of iron powders, which, subsequent to standard processing procedures of metal injection molding, yield intricate parts with microstructures comprising of spheroidal grains of solid solution of iron, nickel, and phosphorous encompassed by an intergranular solid solution of iron phosphide and nickel phosphide, $(Fe,Ni)_3P$. Unlike the polymeric materials or other compounds, $(Fe,Ni)_3P$ is a ferromagnetic material with saturation magnetization of about 14 kilogauss and electrical resistivity close to those of ceramic materials. By controlling the concentration of phosphorous in the ternary-alloy, which is coated on composite powders, it is possible to control the sintered microstructure and hence to obtain soft magnetic components with various combinations of magnetic properties that are suitable for utilization in alternating magnetic fields with different frequencies.

The accompanying figures, which are included to provide a further understanding of the invention, constitute parts of the specified embodiments of the invention and explain the principles of the invention.

DETAILED DESCRIPTION OF THE PREFERRED EMBODIMENT

Figure 1:
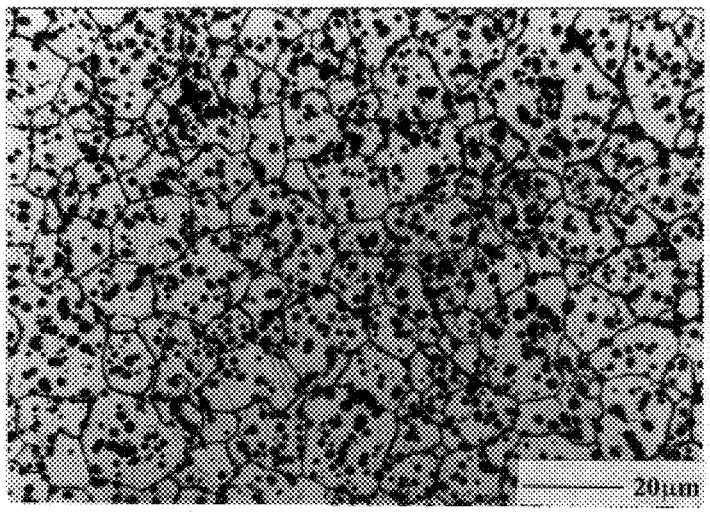
FIG. 1 is a microstructure of Fe—50% Ni alloy sintered at 1350° C. for 60 minutes.

In general, for fabrication soft magnetic components from the ternary iron-nickel-phosphorous alloy powders by using a metal injection molding process in accordance with the present invention, a fine iron powder is first coated with nickel and phosphorous simultaneously in an electroless plating process. The electroless plating formulations comprise of combinations of nickel salts, reducing agents, and stabilizers in various proportions. The composition of the coated composite powder is determined by the types of species and their respective concentrations in the bath solution, as well as the concentrations of reducing agent and stabilizer, pH value, and temperature of the bath solution. The preferred concentration of phosphorous lies between 2.0 and 6.0 wt %, while that of nickel can be varied between 2.0 and 60.0 wt %.

Coated composite powders with high concentrations of phosphorous prepared by electroless plating method are difficult to press as their magnitudes of hardness are very high, which, on the other hand, permits themselves to be processed without significant plastic deformation. However, fine iron powders or mixtures of iron and nickel powders with uniform coated layer of nickel and phosphorous, as per the present invention, lend themselves well as raw materials for metal injection molding so that intricate components can be mass- produced from these powders. In metal injection molding, the coated composite powder is mixed with an organic binder at elevated temperatures, wherein the binder is composed of polypropylene, poly(butyl methacrylate), paraffin wax, and stearic acid. The mixture is then granulated, and fed into injection molder to from the green part, the organic binder in which is subsequently removed in a debinding step. These debound parts are finally subjected to sintering at temperatures ranging from 950° C. to 1200° C. in a reducing atmosphere. Since intricate components with excellent magnetic properties can be achieved at low sintering temperatures, the conventional powder metallurgy sintering furnaces can be utilized.

This approach affords intricate parts possessing uniform sintered shrinkage, high sintered densities, and composite microstructures characterized by grains of solid solution of iron, nickel, and phosphorous embedded in intergranular insulating solid solutions of iron phosphide and nickel phosphide, $(Fe,Ni)_3P$. Unlike the polymer or other compounds, $(Fe,Ni)_3P$ is a ferromagnetic material with saturation magnetization of about 14 kilogauss and electrical resistivity close to those of ceramic materials. The products manufactured according to the present invention are hence far superior to those from Fe—Ni, Fe—Si, and Fe—P alloys processed by conventional powder metallurgy routes. By controlling the fraction of phosphorous in the ternary alloy powders, it is possible to obtain magnetic components with various combinations of magnetic properties to be used in alternating magnetic fields with different frequencies.

The outstanding features of the invention indicated above can be illustrated from the following three examples.

Comparative Example

Carbonyl iron powder (mean particle size of 4 μm) and carbonyl nickel powder (mean particle size of 10 μm) were mixed in equivalent weight fractions. The mixed powder was blended with an organic binder at 180° C., wherein the binder was composed of 30 wt % polypropylene, 15 wt % poly(butyl methacrylate), 50 wt % paraffin wax, and 5 wt % stearic acid. The weight fraction of the powder in the powder-binder mixture was 0.92. Green parts were formed by standard injection molding procedure, and then immersed in mineral spirit to partially dissolve the binder into the solvent. The residual binder in these parts was finally burnt off in a subsequent heat treatment. These parts were then sintered at 1350° C. for 60 minutes in hydrogen atmosphere, resulting in a fractional shrinkage ratio of 0.17. The sintered microstructure is shown in FIG. 1. The grains were irregular in shape, while numerous pores were present within the grains and along the grain boundaries. The properties achieved by this route are summarized in Table 1.

TABLE 1

Properties of injection molded Fe-50Ni alloy prepared as described in the comparative example

| Density (% theoretical) | Saturation Magnetization (kilogauss) | Residual Magnetization (kilogauss) | Electrical Resistivity (μohm cm) | Mean Grain Size (μm) |
|---|---|---|---|---|
| 92 | 12.8 | 10.8 | 58 | 25 |

EXAMPLE I

Carbonyl iron powder (mean particle size of 4 μm) and carbonyl nickel powder (mean particle size of 10 μm) were mixed in equivalent weight fractions. The mixed powder was treated with an acidic water solution prior to plating, wherein it was immersed in a 1% diluted HCl aqueous solution, and maintained at 50° C. for 10 minutes. The weight ratio of powder to the aqueous solution was 7 to 20. The powder was then washed with distilled water and subsequently with acetone. The powder was finally dried in vacuum oven at 60° C. for 2 hours.

Electroless plating was carried out using an acidic type bath solution that was maintained at 90° C. This bath solution was prepared by dissolving 20 grams of nickel sulfate ($NiSO_46H_2O$), 27 grams of sodium hypophosphite ($NaH_2PO_2H_2O$), and 16 grams of sodium succinate ($Na_2C_4H_4O_46H_2O$) in 1 liter diluted $H_2SO_4$ aqueous solution. The initial pH value of the bath solution was adjusted to 6. The powder (100 grams) was then poured into this bath solution and stirred for 30 minutes. The plated powder was then washed and dried according to the same procedures executed prior to plating. The final composition of the powder after plating was Fe—52.3Ni—2.2P.

Figure 2:
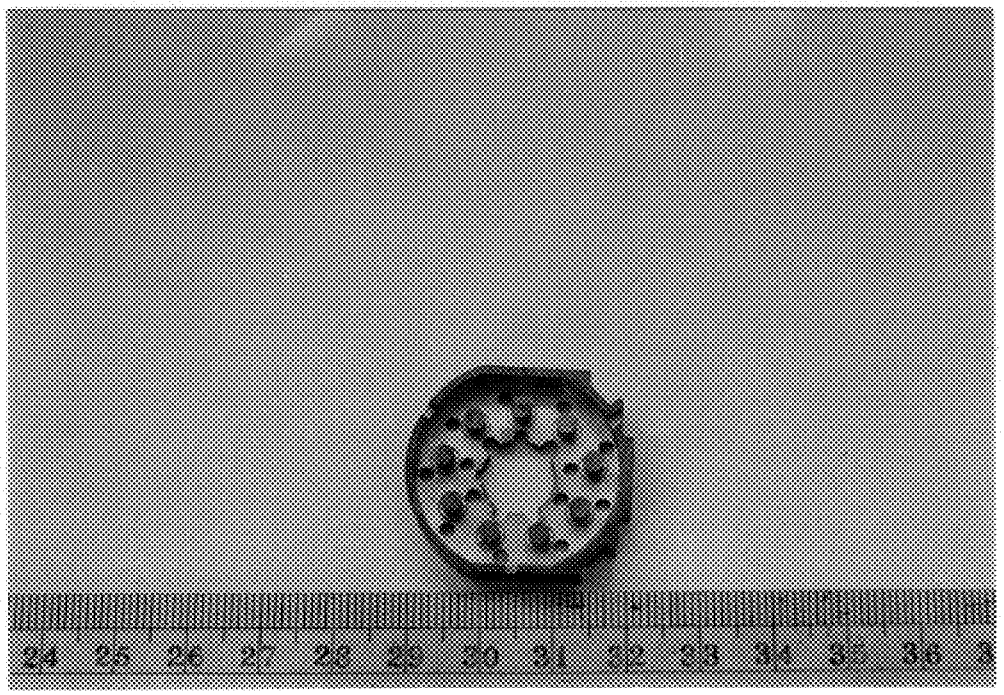
FIG. 2 is an intricate component, which is injection molded using Fe—52.3Ni—2.2P alloy powder.
Figure 3:
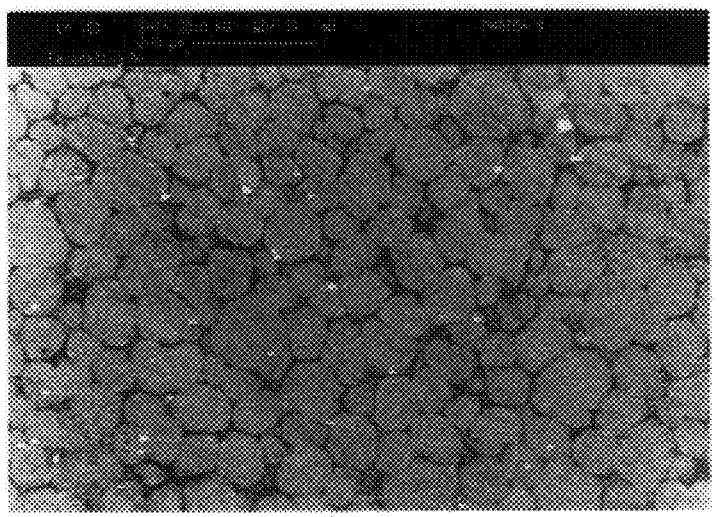
FIG. 3 is a microstructure of Fe—52.3Ni—2.2P sintered at 1200° C. for 60 minutes.

This plated powder was mixed with an organic binder at 180° C., wherein the binder was composed of 30 wt % polypropylene, 15 wt % poly(butyl methacrylate), 50 wt % paraffin wax, and 5 wt % stearic acid. The weight fraction of the powder in the powder-binder mixture was 0.91. Green parts were formed by standard injection molding procedure, and then immersed in mineral spirit in order to partially dissolve the binder into the solvent. The residual binder in these parts was finally burnt off in a subsequent heat treatment. The parts were finally sintered at 1200° C. for 60 minutes in hydrogen atmosphere, resulting in a fractional shrinkage ratio of 0.18. One of the components thus produced is shown in FIG. 2, and its microstructure is shown in FIG. 3. It can be seen that the grains are spheroidal in shape and are surrounded by thin but continuous intergranular phosphide phase. The properties thus achieved are summarized in Table 2.

TABLE 2

Properties of Fe-52.3Ni-2.2P alloy prepared as described in Example I

| Density (% theoretical) | Saturation Magnetization (kilogauss) | Residual Magnetization (kilogauss) | Electrical Resistivity ($\mu$ohm cm) | Mean Grain Size ($\mu$m) |
|---|---|---|---|---|
| 99 | 14.2 | 10.4 | 146 | 64 |

EXAMPLE II

Figure 4:
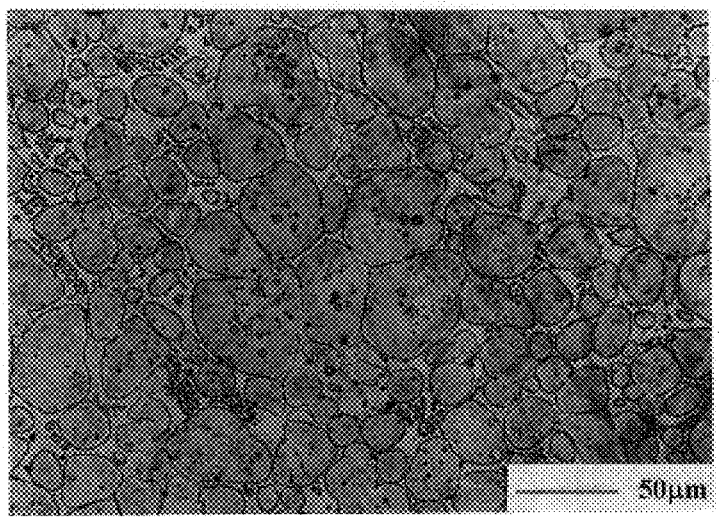
FIG. 4 is a microstructure of Fe—4.4Ni—5.2P alloy sintered at 1050° C. for 30 minutes.

A plating process was carried out according to the same procedures described in Example I, except that only carbonyl iron powder was used and the pH value of the bath solution was changed from 6 to 5. A powder with a final composition of Fe—4.4Ni—5.2P after plating was thus prepared. The same injection molding and sintering procedures were employed, except that the sintering temperature was reduced to 1050° C. and the isothermal holding time was reduced to 30 minutes. FIG. 4 shows a photograph of the resulting microstructure and Table 3 tabulates the corresponding sintered properties. Clearly, the microstructure exhibits a particulate dispersed composite structure wherein the spheroidal grains of solid solution of iron, nickel, and phosphorous are embedded in the intergranular phosphide phase. This structure substantially increases the electrical resistivity of the alloy and, thereby, reduces the eddy current losses in alternating magnetic fields. In addition, though the saturation magnetization of the resulting composite structure is slightly degraded due to the presence of phosphide, as compared to that of fully densified iron alloys, it is nevertheless greatly improved as compared to the non-fully densified powder processed materials.

TABLE 3

Properties of Fe-4.4Ni-5.2P alloy prepared as described in Example II

| Density (% theoretical) | Saturation Magnetization (kilogauss) | Residual Magnetization (kilogauss) | Electrical Resistivity ($\mu$ohm cm) | Mean Grain Size ($\mu$m) |
|---|---|---|---|---|
| 99 | 17.1 | 14.4 | 460 | 48 |

Thus, the aforementioned examples clearly demonstrate that through the utilization of the present invention, a unique and advantageous process can be practiced which affords fabrication of soft magnetic parts possessing both intricate geometry as well as excellent magnetic properties. The main outstanding features of the products processed as per the present invention are enumerated hereafter:

1. As the eutectic liquid phase of nickel and phosphorous is formed at 870° C., uniform distribution of this eutectic liquid phase around the grains of iron powder enhances the sintering of the powder and close to fully densified structure with large grains can be achieved along with saving of energy. In addition, as the density of the material exerts the greatest controlling influence on magnetic properties, the loss of saturation magnetization due to porosity can be minimized.
2. The concentration of phosphorous in the coated composite powder can be adjusted by controlling the plating parameters, such that the fraction of phosphorous in the ternary alloy can be increased from the magnitudes commonly practiced in the prior art, which ranges between 0.4 and 0.8 wt %, to a value close to or even higher than the maximum solubility of phosphorous in Fe—Ni alloys, which is about 2.0wt %, in order to achieve uniform precipitation of the intergranular phosphide around the grains of the solid solution of iron, nickel, and phosphorous.
3. Energy loss due to eddy currents is inversely proportional to the electrical resistivity of the material. Hence, core losses in the devices made from solid blocks are considerably higher than those made from wrought laminated sheets. For applications involving higher frequencies, ferrimagnetic iron oxides are usually used as these materials exhibit almost no eddy current loss at low alternating magnetic frequencies (0 to 1 MHZ). However, the magnitude of saturation magnetization for these ferrimagnetic iron oxides are considerably lower than that for ferromagnetic iron alloys and are usually less than 6 kilogauss. The sintered microstructures achieved by practicing the present invention are characterized by large spheroidal grains embedded in intergranular phosphide phase, resulting in enhanced Bloch wall movement as well as reduced eddy current loss. Hence, high magnitudes of saturation magnetization (>14 kilogauss) and high magnitudes of electrical resistivity (>150 $\mu\Omega$cm) can be achieved as the intergranular phosphide phase is a ferromagnetic and electrical-insulating material.
4. In high frequency alternating magnetic fields, device performance is very sensitive to surface damage because of the "skin effect". In such applications, only the surface of the soft magnetic component responds to the external magnetic field fast enough. Hence, the surface defects caused in secondary operations, such as repressing in powder metallurgy and machining in casting, result in substantial degradation of the performance of the component. With the net-shape forming capability of metal injection molding, this problem is avoided in the present invention.

Although this invention has been described with the preferred embodiments, it is to be understood that variations and modifications may be practiced, as will be apparent to those skilled in the art. Such variations and modifications are to be considered within the purview and the scope of the claims appended hereto.

What is claimed is:

1. A method for fabricating intricate soft magnetic parts with good soft magnetic properties consisting essentially of:

(1) preparing the ternary Fe—Ni—P coated composite powder by electroless plating wherein controlled quantities of nickel and phosphorous are simultaneously plated onto the surface of carbonyl iron powder, yielding a concentration of phosphorous between 2.0 wt % and 6.0 wt %;

(2) mixing together predetermined amounts of the coated composite powder and a binder to form the feedstock;

(3) molding the feedstock into a part of desired shape by injecting the said feedstock under heat and pressure into a mold, and allowing the mixture to solidify;

(4) removing the binder initially by immersing the part in a petroleum type organic solvent and subsequently by heating the part at a temperature below the final sintering temperature, to thereby provide a part which is essentially free of binder;

(5) subjecting the binder-free part to a final sintering temperature in order to achieve densification.

2. The method as claimed in claim 1, wherein reduced carbonyl iron powder is used instead of carbonyl iron powder.

3. The method as claimed in claims 1 and 2, wherein carbonyl nickel powder or reduced carbonyl nickel powder is also added to the carbonyl iron powder or reduced carbonyl iron powder.

4. The method as claimed in claim 3, wherein atomized iron-nickel alloy powder is used instead of carbonyl iron powder.

* * * * *